US008168011B2

(12) United States Patent
Yamasaki et al.

(10) Patent No.: US 8,168,011 B2
(45) **Date of Patent: *May 1, 2012**

(54) HIGH-STRENGTH STEEL WIRE EXCELLENT IN DUCTILITY AND METHOD OF MANUFACTURING THE SAME

(75) Inventors: Shingo Yamasaki, Tokyo (JP); Seiki Nishida, Tokyo (JP); Makio Kikuchi, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 644 days.

This patent is subject to a terminal disclaimer.

(21) Appl. No.: 11/922,524

(22) PCT Filed: Apr. 18, 2007

(86) PCT No.: PCT/JP2007/058897

§ 371 (c)(1),
(2), (4) Date: Dec. 18, 2007

(87) PCT Pub. No.: WO2008/044356

PCT Pub. Date: Apr. 17, 2008

(65) Prior Publication Data

US 2010/0212786 A1 Aug. 26, 2010

(30) Foreign Application Priority Data

Oct. 12, 2006 (JP) ..... 2006-278781

(51) Int. Cl.

| | |
|---|---|
| ***C21D 8/06*** | (2006.01) |
| ***C21D 9/52*** | (2006.01) |
| ***C22C 38/02*** | (2006.01) |
| ***C22C 38/14*** | (2006.01) |
| ***C22C 38/04*** | (2006.01) |

(52) U.S. Cl. ..... 148/330; 148/320; 148/332; 148/333; 148/334; 148/335; 148/336; 148/595; 148/598; 148/599

(58) Field of Classification Search ..... 148/330, 148/320, 332–336, 595, 598–600; 420/121
See application file for complete search history.

(56) References Cited

U.S. PATENT DOCUMENTS 5,458,699 A * 10/1995 Tsukamoto et al. ..... 148/320

FOREIGN PATENT DOCUMENTS

JP 54-044747 4/1981

(Continued)

OTHER PUBLICATIONS

Napolitano, R.E. "Measurement of ASTM grain Size Number," Materials Science & Engineering, Iowa State Unity, Accessed May 26, 2011.*

(Continued)

*Primary Examiner* — Deborah Yee
(74) *Attorney, Agent, or Firm* — Kenyon & Kenyon LLP

(57) ABSTRACT

The invention provides wire rod excellent in drawability and steel wire made from the wire rod as starting material with high productivity at good yield and low cost. A hard steel wire rod of a specified composition is heated in a specified temperature range to conduct post-reaustenization patenting and thereby obtain a high-carbon steel wire excellent in ductility that has a pearlite structure of an area ratio of 97% or greater and the balance of non-pearlite structures including bainite, degenerate-pearlite and pro-eutectoid ferrite and whose fracture reduction of area RA satisfies Expressions (1), (2) and (3) below:

$$RA \geqq RAmin \quad (1),$$

where RAmin=a−b×pearlite block size (μm), $$a = -0.0001187 \times TS\ (\mathrm{MPa})^2 + 0.31814 \times TS\ (\mathrm{MPa}) - 151.32 \quad (2)$$

$$b = 0.0007445 \times TS\ (\mathrm{MPa}) - 0.3753 \quad (3).$$

4 Claims, 2 Drawing Sheets

FOREIGN PATENT DOCUMENTS

| | | |
|---|---|---|
| JP | 56-044747 | 4/1981 |
| JP | 01-316420 | 12/1989 |
| JP | 2609387 | 12/1992 |
| JP | 05-195083 | 8/1993 |
| JP | 6-49592 | 2/1994 |
| JP | 11-199978 | 7/1999 |
| JP | 2000-119805 | 4/2000 |
| JP | 2000-309849 | 7/2000 |
| JP | 2000-355736 | 12/2000 |
| JP | 2001-131697 | 5/2001 |
| JP | 2004-137597 | 5/2004 |
| JP | 2005-126765 | 5/2005 |
| JP | 2006-28619 | 2/2006 |

OTHER PUBLICATIONS

Japanese patent 2004-091912 A, Ofuji Yoshihiro et al., Mar. 25, 2004.*

* cited by examiner

HIGH-STRENGTH STEEL WIRE EXCELLENT IN DUCTILITY AND METHOD OF MANUFACTURING THE SAME

FIELD OF THE INVENTION

This invention relates to steel wire rod, steel wire, and a method of manufacturing the steel wire rod and steel wire. More particularly, this invention relates to steel cord used, for example, to reinforce radial tires, various types of industrial belts, and the like, to rolled wire rod suitable for use in applications such as sewing wire, to methods of manufacturing the foregoing, and to steel wire manufactured from the aforesaid rolled wire rod as starting material.

DESCRIPTION OF THE RELATED ART

In the case of steel wire for steel cord used as a material for reinforcing vehicle radial tires and various types of belts and hoses, or steel wire for sewing wire applications, the general practice is to subject a hot-rolled and controlled-cooling steel wire rod of 5-6 mm diameter to primary drawing for reducing it to a diameter of 3-4 mm, and then to patent the reduced wire rod and conduct secondary drawing for reducing it to a diameter of 1-2 mm. Final patenting is then performed, followed by brass plating and final wet drawing to a diameter of 0.15-0.40 mm. A number of extra fine steel wires obtained by this process are twisted into stranded cable, thereby fabricating steel cord.

Breakage occurring when wire rod is being processed into steel wire or when steel wire is being stranded usually causes major declines in productivity and yield. It is therefore a strong requirement that wire rod and steel wire falling in the aforesaid technical field does not break during drawing or stranding. While breakage can occur during any of the drawing processes, it occurs most readily during the final wet drawing when the diameter of the processed steel wire is extremely fine.

Moreover, recent years have seen an increasing move toward lighter weight steel cord and similar products for various purposes. This requires the aforesaid products to offer high strength of a level that cannot be achieved by carbon steel wire rod etc. with a C content of less than 0.7 mass %, so that there is ever greater use of steel wire having a C content of 0.75 mass % or greater. However, increasing C content degrades drawability and thus leads to more frequent breakage. As a result, a very strong need is felt for wire rod that achieves high steel wire strength by dint of abundant C content and that is also excellent in drawability.

In response to such recent industrial requirements, a number of techniques have been proposed for enhancing the drawability of high-carbon wire rod such as by controlling segregation and/or microstructure or by incorporation of special elements.

For example, Japanese Patent No. 2609387 teaches "a wire rod for extra fine steel wire of high strength and high toughness, an extra fine steel wire of high strength and high toughness, a stranded product using the extra fine steel wire, and a method of manufacturing the extra fine steel wire," wherein the steel has a specified chemical composition and the average area ratio of pro-eutectoid cementite content is prescribed. However, the wire rod taught by this patent is costly to manufacture because it requires inclusion of one or both of the expensive elements Ni and Co.

On the other hand, the reduction of area of patented wire rod is a function of austenite grain size, and since this makes it possible to improve reduction of area by refining the austenite grain size, attempts have been made to achieve austenite grain size refinement by using carbides and/or nitrides of elements such as Nb, Ti and B as pinning particles. Japanese Patent No. 2609387 teaches further improvement of extra fine wire rod toughness/ductility by incorporation of one or more of Nb: 0.01-0.1 mass %, Zr: 0.05-0.1 mass % and Mo: 0.02 to 0.5 mass % as constituent elements. In addition, Japanese Patent Publication (A) No. 2001-131697 teaches austenite grain diameter refinement using NbC. However, the high price of these addition elements increases cost. Moreover, Ni forms coarse carbide and nitride and Ti forms coarse oxide, so that when the wire is drawn to a fine diameter of, for example, 0.40 mm or less, breakage may occur. A study carried out by the inventors found that BN pinning is not readily capable of refining austenite grain diameter to a degree that affects the reduction of area.

Further, Japanese Patent Publication (A) Nos. 2000-309849, S56-44747 and H01-316420 teach enhancement of high-carbon wire rod drawability by using Ti and B to fix solid-solute N. However, reports published in recent years point out that drawability cannot be easily enhanced by fixing solute N prior to drawing because decomposition of cementite in the wire rod during drawing increases the amount of solid-solute C.

Moreover, although Japanese Patent Publication (A) Nos. 2000-355736 and 2004-137597 teach use of solid-solute B to inhibit ferrite precipitation, they entail a high risk of wire breakage because they give no consideration to the fact that solid-solute B promotes precipitation of coarse cementite ($Fe_{23}(CB)_6$).

SUMMARY OF THE INVENTION

The present invention was conceived in light of the foregoing circumstances. Its object is to provide wire rod whose excellent cold workability, particularly excellent drawability, make it ideal for steel cord, sewing wire and similar applications, and also to provide steel wire made from the wire rod as starting material with high productivity at good yield and low cost.

This invention achieves the foregoing object by a method of manufacture constituted to enable production of the steel wire rods set forth in aspects 1) to 3) below, establishment of the method of producing steel wire rod set forth in aspect 4) below, and production of the high-strength steel wire set forth in aspect 5) below.

1) A steel wire rod comprising a post-patenting pearlite structure of an area ratio of 97% or greater and a balance of non-pearlite structures including bainite, degenerate-pearlite and pro-eutectoid ferrite, whose fracture reduction of area RA satisfies Expressions (1), (2) and (3) below and whose tensile strength TS satisfies Expression (4) below:

$$RA \geqq Ramin \quad (1),$$

where RAmin=a−b×pearlite block size (μm), $$a=-0.0001187\times TS\ (\text{MPa})^2+0.31814\times TS\ (\text{MPa})-151.32 \quad (2)$$

$$b=0.0007445\times TS\ (\text{MPa})-0.3753 \quad (3)$$

$$TS \geqq 1000\times C\ (\text{mass }\%)-10\times \text{wire diameter (mm)}+320\ \text{Mpa} \quad (4).$$

2) A steel wire rod according to 1), comprising, in mass %
C: 0.70 to 1.10%,
Si: 0.1 to 1.5%,
Mn: 0.1 to 1.0%
Al: 0.01% or less, Ti: 0.01% or less, N: 10 to 60 mass ppm, B: not less than (0.77×N (mass ppm)−17.4) mass ppm or 3 mass ppm, whichever is greater, and not greater than 52 mass ppm, and the balance of Fe and unavoidable impurities.

3) A steel wire rod according to 2), further comprising, in mass %, one or more members selected from the group consisting of:

Cr: 0.03 to 0.5%,

Ni: 0.5% or less (not including 0%),

Co: 0.5% or less (not including 0%),

V: 0.03 to 0.5%,

Cu: 0.2% or less (not including 0%),

Mo: 0.2% or less (not including 0%),

W: 0.2% or less (not including 0%), and

Nb: 0.1% or less (not including 0%).

4) A method of manufacturing the steel wire rod according to 1), comprising:

heating a wire rod having the chemical composition of 2) or 3) at a temperature between Tmin shown below and 1100° C.; and subjecting the wire rod to patenting in an atmosphere of 500 to 650° C., in which a cooling rate between 800 and 650° C. is 50° C./s or greater, said minimum heating temperature Tmin being 850° C. when B (mass ppm)−0.77×N (mass ppm)>0.0, and said minimum heating temperature Tmin being Tmin=1000+1450/(B (mass ppm)−0.77×N (mass ppm)−10)° C. when B (mass ppm)−0.77×N (mass ppm)≦0.0.

5) A high-strength steel wire excellent in ductility, which is manufactured by subjecting the steel wire rod of 1) to cold drawing and has a tensile strength of 2800 MPa or greater.

DETAILED DESCRIPTION OF THE INVENTION

Figure 1:
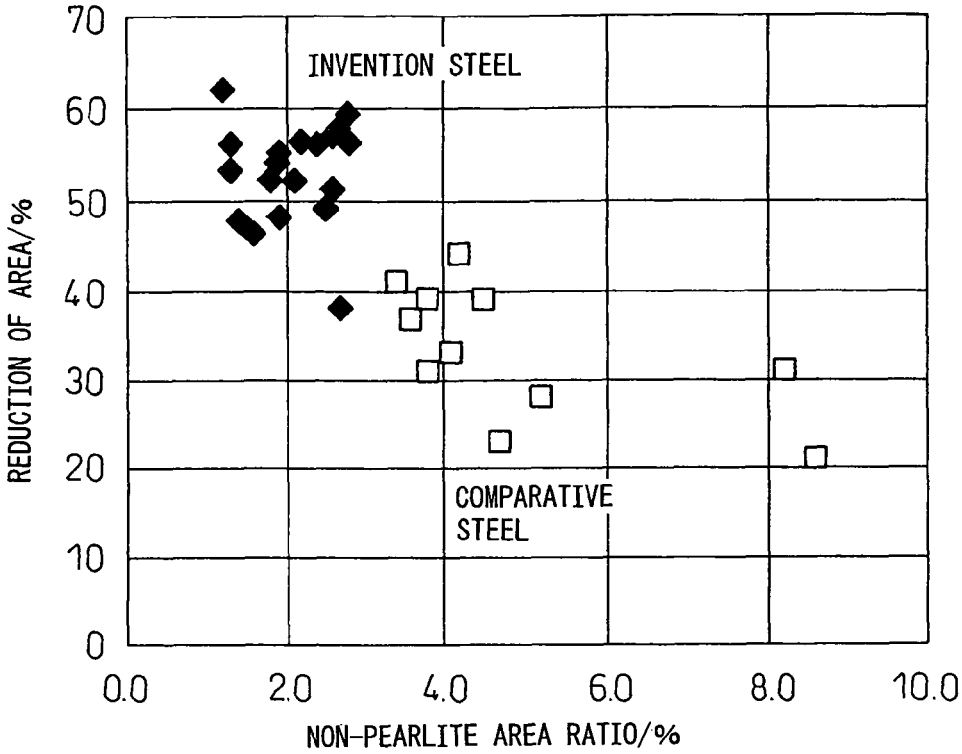
FIG. 1 is a diagram showing how reduction of area varied as a function of non-pearlite area ratio.

The inventors conducted studies regarding how the chemical composition and mechanical properties of a wire rod affect its drawability. Their findings are set out below.

a) Although tensile strength can be enhanced by increasing the content of alloying metals such as C, Si, Mn and Cr, a higher content of these alloying metals lowers drawability, namely, increases breakage frequency by causing a reduction in working limit during drawing.

b) Drawability can be estimated from tensile strength and fracture reduction of area before drawing, i.e., after heat treatment. Drawability after final heat treatment exhibits particularly good correlation with tensile strength and reduction of area after final heat treatment, and very good drawability is obtained when reduction of area reaches or exceeds a certain value in correspondence to tensile strength.

c) B forms a compound with N, and the amount of solid-solute B is determined by the total amounts of B and N and the heating temperature before pearlite transformation. Solid-solute B segregates at austenite grain boundaries. During cooling from the austenite temperature at the time of patenting, it inhibits generation of coarse, low-strength microstructures such as bainite, ferrite and degenerate-pearlite that originate from the austenite grain boundaries, and particularly inhibits bainite generation. Among these non-pearlite structures, bainite is the one that has the greatest adverse effect on drawability. Bainite accounts for 60% or greater of the non-pearlite structures. When solid-solute B is deficient, the foregoing effect is minimal, and when it is excessive, pearlite transformation is preceded by precipitation of coarse $Fe_{23}(CB)_6$ that degrades drawability.

This invention was achieved based on the foregoing findings.

The requirements of the invention will now be explained in detail.

Structure and Mechanical Properties of the Wire Rod:

It is known that the reduction of area of patented wire rod is improved by refining pearlite block size, which is substantially proportional to austenite grain diameter, to 10 μm or less, and that the precipitates TiN, AlN, NbC etc. contribute to austenite grain refinement. However, in a wire rod for steel cord, addition of Ti and/or Al is difficult because the coarse oxides that form cause wire breakage. Use of Nb is also difficult because there is a risk of coarse NbC formation. If pearlite block size refinement is to be achieved without using these precipitates, it is necessary to lower the austenite heating temperature and/or shorten the heating time. But such a method is hard to implement in an actual operation because it makes stable and fine control of austenite grain diameter extremely difficult. In contrast, this invention is characterized in enabling enhancement of wire rod reduction of area, without need for marked block size refinement, by restraining non-pearlite structures constituted of ferrite, degenerate-pearlite and bainite present in the patented wire rod to 3% or less.

The inventors discovered that the fracture reduction of area RA of conventionally used wire rod is correlated with tensile strength TS and pearlite block size as follows:

$$RA \geqq RAmin \quad (1),$$

where RAmin=a−b×pearlite block size (μm), $$a = -0.0001187 \times TS\ (\mathrm{MPa})^2 + 0.31814 \times TS\ (\mathrm{MPa}) - 151.32 \quad (2)$$

$$b = 0.0007445 \times TS\ (\mathrm{MPa}) - 0.3753 \quad (3).$$

They further determined that the starting points of cracks occurring during tensile testing are non-pearlite structures that do not exhibit regular lamellar structures, specifically pro-eutectoid ferrite occurring at the former γ grain boundaries, bainite and/or degenerate-pearlite, and discovered that the fracture reduction of area can be dramatically improved by restraining the non-pearlite structure fraction to 3% or less, and that for reducing non-pearlite structures it is effective to add B and to regulate the heating temperature before patenting in accordance with the amount of added B, specifically to conduct heating before patenting at a temperature between the minimum heating temperature Tmin defined by the expression below and 1100° C. and conduct patenting in an atmosphere of 500 to 650° C., in which the cooling rate between 800 and 650° C. is 50° C./s or greater:

said minimum heating temperature Tmin being 850° C. when B (mass ppm)−0.77×N (mass ppm)>0.0, and said minimum heating temperature Tmin being Tmin=1000+1450/(B (mass ppm)−0.77×N (mass ppm)−10)° C. when B (mass ppm)−0.77×N (mass ppm)≦0.0.

This enables manufacture of a high-strength wire rod having the reduction of area defined by Expression (1).

Chemical Composition:

C: C is an element that effectively enhances the strength of the wire rod. However, at a content of less than 0.70 mass %, C cannot easily be made to reliably impart high strength to the final product, while uniform pearlite structure becomes hard to achieve owing to promotion of pro-eutectoid ferrite precipitation at the austenite grain boundaries. When C content is excessive, reticulate pro-eutectoid cementite arising at the austenite grain boundaries causes easy breakage during wire drawing and also markedly degrades the toughness and ductility of the extra fine wire rod after the final drawing. C content is therefore defined as 0.70 to 1.10 mass %

Si: Si is an element that effectively enhances strength. It is also an element useful as a deoxidizer and, as such, is a required element when the invention is applied to a steel wire rod that does not contain Al. The deoxidizing action of Ti is too low at a content of less than 0.1 mass %. When the Si content is excessive, it promotes pro-eutectoid ferrite precipitation even in a hypereutectoid steel and also causes a reduction in working limit during drawing. In addition, it hampers mechanical descaling (MD) in the drawing process. Si content is therefore defined as 0.1 to 1.5 mass %.

Mn: Like Si, Mn is also an element useful as a deoxidizer. It is further effective for improving hardenability and thus for enhancing wire rod strength. Mn also acts to prevent hot brittleness by fixing S present in the steel as MnS. At a content of less than 0.1 mass % the aforesaid effects are not readily obtained. On the other hand, Mn is an element that easily precipitates. When present in excess of 1.0 mass %, it segregates particularly at the center region of the wire rod, and since martensite and/or bainite form in the segregation region, drawability is degraded. Mn content is therefore defined as 0.1 to 1.0 mass %.

Al: 0.01 mass % or less. In order to ensure that the Al does not generate hard, undeformable alumina nonmetallic inclusions that degrade the ductility and drawability of the steel wire, its content is defined as 0.01 mass % or less (including 0 mass %).

Ti: 0.01 mass % or less. In order to ensure that the Ti does not generate hard, undeformable oxide that degrades the ductility and drawability of the steel wire, its content is defined as 0.01 mass % or less (including 0 mass %).

N: 10 to 60 mass ppm. N in the steel forms a nitride with B and thus works to prevent austenite grain coarsening during heating. This action is effectively exhibited at an N content of 10 mass ppm or greater. At too high an N content, however, nitrides form excessively to lower the amount of solid-solute B present in the austenite. In addition, solid-solute N is liable to promote aging during wire drawing. The upper limit of N content is therefore defined as 60 mass ppm.

B: between 3 mass ppm or (0.77×N (mass ppm)−17.4) mass ppm and 52 mass ppm. When B is present in austenite in solid solution, it segregates at the grain boundaries and inhibits precipitation of ferrite, degenerate-pearlite, bainite and the like at the grain boundaries. On the other hand, excessive B addition has an adverse effect on drawability because it promotes precipitation of coarse carbide, namely $Fe_{23}(CB)_6$, in the austenite. The lower limit of B content is therefore defined as 3 mass ppm or (0.77×N (mass ppm)−17.4) mass ppm, whichever is greater, and the upper limit is defined as 52 mass ppm.

The contents of the impurities P and S are not particularly defined, but from the viewpoint of achieving good ductility, the content of each is preferably 0.02 mass % or less, similarly to in conventional extra fine steel wires.

Although the steel wire rod used in the present invention has the aforesaid elements as its basic components, one or more of the following optional additive elements can be positively included in addition for the purpose of improving strength, toughness, ductility and other mechanical properties:

Cr: 0.03 to 0.5 mass %, Ni: 0.5 mass % or less, Co: 0.5 mass % or less, V: 0.03 to 0.5 mass %, Cu: 0.2 mass % or less, Mo: 0.2 mass % or less, W: 0.2 mass % or less, and Nb: 0.1 mass % or less (where the content ranges of Ni, Co, Cu, Mo, W and Nb do not include 0 mass %). Explanation will now be made regarding these elements.

Cr: 0.03 to 0.5 mass %. As Cr reduces lamellar spacing, it is an effective element for improving the strength, drawability and other properties of the wire rod. For taking full advantage of these effects, Cr is preferably added to a content of 0.03 mass % or greater. At an excessive content, however, Cr prolongs the time to completion of transformation, thus increasing the likelihood of the occurrence of martensite, bainite and other undercooled structures in the hot-rolled wire rod, and also degrades mechanical descaling ability. The upper limit of Cr content is therefore defined as 0.5 mass %.

Ni: 0.5 mass % or less. Ni does not substantially contribute to wire rod strength improvement but is an element that enhances toughness of the drawn wire. Addition of 0.1 mass % or greater of Ni is preferable for effectively enabling this action. At an excessive content, however, Ni prolongs the time to completion of transformation. The upper limit of Ni content is therefore defined as 0.5 mass %.

Co: 1 mass % or less. Co is an element effective for inhibiting precipitation of pro-eutectoid cementite in the rolled product. Addition of 0.1 mass % or greater of Co is preferable for effectively enabling this action. Excessive addition of Co is economically wasteful because the effect saturates. The upper limit of Co content is therefore defined as 0.5 mass %.

V: 0.03 to 0.5 mass %. V forms fine carbonitrides in austenite, thereby preventing coarsening of austenite grains during heating and improving ductility, and also contributes to post-rolling strength improvement. Addition of 0.03 mass % or greater of V is preferable for effectively enabling this action. However, when the V is added in excess, the amount of carbonitrides formed becomes too large and the grain diameter of the carbonitrides increases. The upper limit of V content is therefore defined as 0.5 mass %.

Cu: 0.2 mass % or less. Cu enhances the corrosion resistance of the extra fine steel wire. Addition of 0.1 mass % or greater of Cu is preferable for effectively enabling this action. However, when Cu is added in excess, it reacts with S to cause segregation of CuS at the grain boundaries. As a result, flaws occur in the steel ingot, wire rod etc. in the course of wire rod manufacture. To preclude this adverse effect, the upper limit of Cu content is defined as 0.2 mass %.

Mo: Mo enhances the corrosion resistance of the extra fine steel wire. Addition of 0.1 mass % or greater of Mo is preferable for effectively enabling this action. At an excessive content, however, Mo prolongs the time to completion of transformation. The upper limit of Mo content is therefore defined as 0.2 mass %.

W: W enhances the corrosion resistance of the extra fine steel wire. Addition of 0.1 mass % or greater of W is preferable for effectively enabling this action. At an excessive content, however, W prolongs the time to completion of transformation. The upper limit of W content is therefore defined as 0.2 mass %.

Nb: Nb enhances the corrosion resistance of the extra fine steel wire. Addition of 0.05 mass % or greater of Nb is preferable for effectively enabling this action. At an excessive content, however, Nb prolongs the time to completion of transformation. The upper limit of Nb content is therefore defined as 0.1 mass %.

Drawing Conditions:

By subjecting the steel wire rod according to aspect 1) of this invention to cold drawing, there can be obtained a high-strength steel wire excellent in ductility that is characterized by having a tensile strength of 2800 MPa or greater. The true strain of the cold-drawn wire is 3 or greater, preferably 3.5 or greater.

EXAMPLES

The present invention will now be explained more concretely with reference to working examples. However, the present invention is in no way limited to the following examples and it should be understood that appropriate modification can be made without departing from the gist of the present invention and that all such modifications fall within technical scope of the present invention.

Hard steel wire rods of the compositions shown in Table 1 were prepared to a diameter of 1.2 to 1.6 mm by patenting and drawing and then patented by lead patenting (LP) or fluid bed patenting (FBP).

Non-pearlite volume fraction measurement was conducted by embedding resin in an L-section of a rolled wire rod, polishing it with alumina, corroding the polished surface with saturated picral, and observing it with a scanning electron microscope (SEM). The region observed by the SEM was divided into Surface, ¼ D and ½ D zones (D standing for wire diameter) and 10 photographs, each of an area measuring 50×40 μm, were taken at random locations in each zone at a magnification of ×3000. The area ratio of degenerate-pearlite portions including dispersed granular cementite, bainite portions including plate-like cementite dispersed with spacing of three or more times the lamellar spacing of surrounding pearlite portion, and pro-eutectoid ferrite portions precipitated along austenite were subjected to image processing and the value obtained by the analysis was defined as the non-pearlite volume fraction.

The pearlite block size of patented wire rod was determined by embedding resin in an L-section of the wire rod, polishing it, using EBSP analysis to identify regions enclosed by boundaries of an orientation difference of 9 degrees as individual blocks, and calculating the average block size from the average volume of the blocks.

After the patented wire rod had been cleared of scale by pickling, it was imparted with a zinc phosphate coating by Bonde coating and subjected to continuous drawing at an area reduction rate of 16 to 20% per pass using dice each having an approach angle of 10 degrees, thereby obtaining a high-strength drawn wire rod of a diameter of 0.18 to 0.30 mm.

TABLE 1

| | | Chemical compositions (Mass % (except for B and N)) | | | | | | | | | | | | | | | | |
|---|---|---|---|---|---|---|---|---|---|---|---|---|---|---|---|---|---|---|
| No. | | C | Si | Mn | P | S | B(ppm) | Al | Ti | N(ppm) | Cr | Mo | Ni | Cu | V | Co | W | Nb |
| 1 | Invention | 0.70 | 0.30 | 0.45 | 0.019 | 0.025 | 24 | 0.000 | 0.000 | 20 | — | — | — | — | — | — | — | — |
| 2 | Invention | 0.82 | 0.20 | 0.51 | 0.015 | 0.013 | 15 | 0.000 | 0.000 | 12 | 0.20 | — | — | — | — | — | — | — |
| 3 | Invention | 0.82 | 0.20 | 0.49 | 0.010 | 0.007 | 16 | 0.000 | 0.000 | 50 | — | — | — | — | — | — | — | — |
| 4 | Invention | 0.92 | 0.25 | 0.46 | 0.019 | 0.025 | 30 | 0.000 | 0.000 | 60 | — | — | 0.10 | — | — | — | — | — |
| 5 | Invention | 0.87 | 1.20 | 0.5 | 0.008 | 0.007 | 46 | 0.001 | 0.000 | 50 | 0.20 | — | — | — | — | — | — | — |
| 6 | Invention | 1.09 | 0.20 | 0.5 | 0.010 | 0.009 | 25 | 0.000 | 0.001 | 50 | 0.20 | — | — | 0.10 | — | — | — | — |
| 7 | Invention | 0.92 | 0.60 | 0.5 | 0.025 | 0.020 | 30 | 0.001 | 0.000 | 25 | — | — | — | — | — | — | 0.10 | 0.10 |
| 8 | Invention | 0.82 | 0.20 | 0.5 | 0.008 | 0.008 | 11 | 0.000 | 0.000 | 34 | — | — | — | — | — | — | — | — |
| 9 | Invention | 0.82 | 0.20 | 0.5 | 0.008 | 0.008 | 11 | 0.000 | 0.000 | 20 | — | — | — | — | — | — | — | — |
| 10 | Invention | 0.82 | 0.20 | 0.5 | 0.008 | 0.008 | 20 | 0.001 | 0.000 | 25 | — | — | — | — | — | — | — | — |
| 11 | Invention | 0.82 | 0.20 | 0.5 | 0.008 | 0.008 | 20 | 0.000 | 0.000 | 35 | — | — | — | — | — | — | — | — |
| 12 | Invention | 0.82 | 0.20 | 0.5 | 0.008 | 0.008 | 11 | 0.000 | 0.000 | 35 | — | — | — | — | — | — | — | — |
| 13 | Invention | 0.82 | 0.20 | 0.5 | 0.008 | 0.008 | 15 | 0.000 | 0.000 | 25 | — | — | — | — | — | — | — | — |
| 14 | Invention | 0.82 | 0.20 | 0.5 | 0.008 | 0.008 | 21 | 0.000 | 0.000 | 16 | — | — | — | — | — | — | — | — |
| 15 | Invention | 0.82 | 0.22 | 0.5 | 0.008 | 0.008 | 20 | 0.001 | 0.000 | 35 | 0.20 | — | — | — | 0.20 | — | — | — |
| A | Invention | 0.92 | 0.20 | 0.5 | 0.008 | 0.008 | 15 | 0.000 | 0.000 | 25 | 0.20 | — | — | — | 0.03 | — | — | — |
| B | Invention | 0.92 | 0.20 | 0.5 | 0.008 | 0.008 | 10 | 0.000 | 0.000 | 21 | 0.20 | — | — | — | 0.06 | — | — | — |
| C | Invention | 1.02 | 0.20 | 0.5 | 0.008 | 0.008 | 15 | 0.000 | 0.000 | 25 | 0.20 | — | — | — | 0.03 | — | — | — |
| D | Invention | 1.02 | 0.20 | 0.5 | 0.008 | 0.008 | 10 | 0.000 | 0.000 | 21 | 0.20 | — | — | — | 0.06 | — | — | — |
| E | Invention | 0.82 | 0.21 | 0.48 | 0.009 | 0.009 | 12 | 0.000 | 0.000 | 24 | 0.03 | — | — | — | — | — | — | — |
| F | Invention | 0.82 | 0.19 | 0.51 | 0.009 | 0.009 | 11 | 0.000 | 0.000 | 25 | 0.06 | — | — | — | — | — | — | — |
| G | Invention | 0.92 | 0.20 | 0.5 | 0.008 | 0.008 | 9 | 0.000 | 0.000 | 23 | 0.05 | — | — | — | 0.04 | — | — | — |
| H | Invention | 1.01 | 0.20 | 0.5 | 0.008 | 0.009 | 10 | 0.000 | 0.000 | 23 | 0.05 | — | — | — | 0.03 | — | — | — |
| I | Invention | 1.02 | 0.20 | 0.5 | 0.008 | 0.008 | 8 | 0.000 | 0.000 | 21 | 0.04 | — | — | — | — | — | — | — |
| 16 | Comparative | 0.70 | 0.30 | 0.6 | 0.008 | 0.007 | 11 | 0.000 | 0.000 | 35 | — | 0.20 | — | — | — | — | — | — |
| 17 | Comparative | 0.82 | 0.20 | 0.5 | 0.010 | 0.009 | 2 | 0.000 | 0.010 | 50 | 0.20 | — | — | — | — | — | — | — |
| 18 | Comparative | 0.90 | 0.20 | 0.8 | 0.010 | 0.009 | 60 | 0.000 | 0.005 | 25 | — | — | 0.10 | — | — | — | — | — |
| 19 | Comparative | 0.87 | 1.70 | 0.4 | 0.015 | 0.013 | 20 | 0.000 | 0.010 | 25 | 0.20 | — | — | — | — | — | — | — |
| 20 | Comparative | 1.30 | 1.00 | 0.3 | 0.015 | 0.013 | 20 | 0.030 | 0.000 | 25 | — | — | — | — | — | 0.30 | — | — |
| 21 | Comparative | 0.92 | 0.30 | 1.5 | 0.015 | 0.013 | 20 | 0.000 | 0.000 | 25 | — | — | — | — | 0.20 | — | — | — |
| 22 | Comparative | 0.82 | 1.00 | 0.5 | 0.025 | 0.020 | 20 | 0.030 | 0.000 | 35 | — | — | — | — | 0.20 | — | — | — |
| 23 | Comparative | 0.96 | 0.20 | 0.5 | 0.010 | 0.009 | 0 | 0.000 | 0.010 | 25 | 0.20 | — | — | — | 0.10 | — | — | — |
| 24 | Comparative | 0.82 | 0.20 | 0.5 | 0.010 | 0.009 | 0 | 0.000 | 0.010 | 25 | — | — | — | — | — | — | — | — |
| 25 | Comparative | 0.82 | 0.20 | 0.5 | 0.010 | 0.009 | 0 | 0.000 | 0.010 | 25 | — | — | — | — | — | — | — | — |
| 26 | Comparative | 0.82 | 0.20 | 0.5 | 0.010 | 0.009 | 0 | 0.000 | 0.010 | 25 | — | — | — | — | — | — | — | — |
| 27 | Comparative | 0.82 | 0.20 | 0.5 | 0.010 | 0.009 | 0 | 0.000 | 0.010 | 25 | — | — | — | — | — | — | — | — |
| 28 | Comparative | 0.82 | 0.20 | 0.45 | 0.019 | 0.025 | 24 | 0.000 | 0.000 | 25 | — | — | — | — | — | — | — | — |

TABLE 2

| No. | Diameter (mm) | Heat temp (° C.) | Patenting method | Patenting temp (° C.) | 800→650° C. cool rate (° C./sec) | Patented product strength (MPa) | Block size (μm) | Reduction of area (%) | Tmin (° C.) | RA min (%) | Non-pearlite area ratio (%) | Final drawing diameter (mm) | Final drawing TS (MPa) | Remark |
|---|---|---|---|---|---|---|---|---|---|---|---|---|---|---|
| 1 | 1.60 | 860 | LP | 575 | 348 | 1244 | 10 | 59 | 850 | 55 | 2.8 | 0.20 | 3776 | |
| 2 | 1.40 | 880 | LP | 550 | 480 | 1310 | 12 | 56 | 850 | 55 | 2.4 | 0.22 | 3541 | |
| 3 | 1.60 | 1100 | LP | 575 | 348 | 1328 | 36 | 56 | 955 | 40 | 1.3 | 0.22 | 3846 | |
| 4 | 1.50 | 1000 | LP | 600 | 296 | 1313 | 21 | 52 | 945 | 49 | 2.1 | 0.20 | 3862 | |
| 5 | 1.30 | 855 | LP | 570 | 119 | 1515 | 12 | 49 | 850 | 49 | 2.5 | 0.22 | 3930 | |
| 6 | 1.40 | 1000 | LP | 550 | 480 | 1521 | 27 | 38 | 938 | 38 | 2.7 | 0.20 | 4321 | |
| 7 | 1.40 | 870 | LP | 575 | 401 | 1466 | 10 | 56 | 850 | 53 | 2.8 | 0.20 | 4165 | |
| 8 | 1.45 | 950 | LP | 575 | 386 | 1329 | 16 | 53 | 942 | 52 | 1.3 | 0.20 | 3844 | |
| 9 | 1.45 | 950 | FBP | 575 | 149 | 1231 | 16 | 56 | 899 | 52 | 2.2 | 0.20 | 3560 | |
| 10 | 1.30 | 870 | LP | 575 | 433 | 1329 | 12 | 57 | 850 | 54 | 2.6 | 0.18 | 3836 | |
| 11 | 1.50 | 940 | LP | 575 | 373 | 1319 | 15 | 54 | 914 | 53 | 1.9 | 0.20 | 3881 | |
| 12 | 1.45 | 1050 | LP | 575 | 386 | 1328 | 25 | 55 | 944 | 46 | 1.9 | 0.20 | 3841 | |
| 13 | 1.40 | 920 | LP | 575 | 401 | 1339 | 16 | 53 | 898 | 52 | 1.9 | 0.20 | 3803 | |
| 14 | 1.30 | 920 | FBP | 570 | 173 | 1231 | 15 | 62 | 839 | 52 | 1.2 | 0.20 | 3364 | |
| 15 | 1.50 | 1050 | LP | 575 | 373 | 1332 | 31 | 51 | 914 | 43 | 2.6 | 0.20 | 3918 | |
| A | 1.40 | 950 | FBP | 575 | 148 | 1407 | 21 | 48 | 898 | 47 | 1.9 | 0.20 | 4053 | |
| B | 1.50 | 950 | FBP | 575 | 146 | 1407 | 18 | 52 | 910 | 49 | 1.8 | 0.20 | 4197 | |
| C | 1.40 | 950 | FBP | 575 | 142 | 1486 | 22 | 46 | 898 | 43 | 1.6 | 0.20 | 4394 | |
| D | 1.50 | 950 | FBP | 575 | 146 | 1486 | 16 | 48 | 910 | 48 | 1.4 | 0.20 | 4550 | |
| E | 1.45 | 950 | FBP | 575 | 143 | 1289 | 21 | 51 | 912 | 49 | 1.8 | 0.20 | 3881 | |
| F | 1.45 | 950 | FBP | 575 | 146 | 1289 | 19 | 52 | 921 | 50 | 2.1 | 0.20 | 3883 | |
| G | 1.45 | 950 | FBP | 575 | 150 | 1388 | 24 | 47 | 923 | 46 | 2.2 | 0.20 | 4179 | |
| H | 1.40 | 950 | FBP | 575 | 150 | 1458 | 23 | 44 | 918 | 44 | 1.9 | 0.20 | 4313 | |
| I | 1.40 | 950 | FBP | 575 | 152 | 1466 | 25 | 43 | 920 | 42 | 1.6 | 0.20 | 4337 | |
| 16 | 1.40 | 850 | LP | 575 | 401 | 1261 | 15 | 33 | 944 | 53 | 4.1 | 0.20 | 3582 | |
| 17 | 1.40 | 870 | LP | 570 | 417 | 1327 | 10 | 39 | 969 | 56 | 4.5 | 0.20 | 3770 | |
| 18 | 1.50 | 860 | LP | 600 | 296 | 1326 | 11 | 56 | 850 | 55 | 2.9 | 0.20 | 3902 | pro-eutectoid θ |
| 19 | 1.40 | 900 | LP | 575 | 401 | 1577 | 14 | 21 | 850 | 44 | 8.6 | 0.25 | 3967 | pro-eutectoid α |
| 20 | 1.20 | 920 | LP | 575 | 470 | 1799 | 11 | 23 | 850 | 26 | 4.7 | 0.30 | 3642 | pro-eutectoid θ |
| 21 | 1.40 | 920 | LP | 575 | 401 | 1519 | 14 | 31 | 850 | 47 | 3.8 | 0.20 | 4316 | micro-martensite |
| 22 | 1.30 | 820 | LP | 600 | 343 | 1349 | 10 | 31 | 914 | 56 | 8.2 | 0.20 | 3685 | |
| 23 | 1.50 | 950 | FBP | 575 | 144 | 1341 | 20 | 37 | 950 | 49 | 3.6 | 0.20 | 3944 | No B |
| 24 | 1.50 | 870 | LP | 575 | 373 | 1319 | 13 | 41 | 950 | 54 | 3.4 | 0.20 | 3881 | No B |
| 25 | 1.45 | 1050 | LP | 575 | 386 | 1339 | 28 | 28 | 950 | 44 | 5.2 | 0.20 | 3872 | No B |
| 26 | 1.45 | 950 | LP | 575 | 386 | 1329 | 21 | 39 | 950 | 49 | 3.8 | 0.20 | 3844 | No B |
| 27 | 1.45 | 900 | LP | 575 | 386 | 1323 | 10 | 44 | 950 | 56 | 4.2 | 0.20 | 3827 | No B |
| 28 | 1.80 | 950 | AP | — | 30 | 1020 | 23 | 28 | 850 | 43 | 2.7 | 0.18 | 3594 | TS deficient |

Table 1 shows the chemical compositions of the evaluated products, and Table 2 shows their test conditions, block size and mechanical properties.

In Tables 1 and 2, 1 to 15 and A to I are invention steels and 16 to 28 are comparative steels. The minimum reduction of area represented by Expression (1) is designated RAmin. RAmin means the value represented by the equation: RAmin=a−b×pearlite block size (μm).

16 and 22 are cases in which the reduction of area was low because a low heating temperature before patenting caused B nitride and carbide to precipitate before patenting and thus make it impossible to obtain adequate solid-solute B. 17 and 23 to 27 are cases in which reduction of area was low because the amount of added B was either low or nil. 18 is a case in which reduction of area was low because excessive B content caused heavy precipitation of B carbide and pro-eutectoid cementite at the austenite grain boundaries. 19 is a case in which pro-eutectoid ferrite precipitation could not be inhibited because Si content was excessive. 20 is a case in which pro-eutectoid cementite precipitation could not be inhibited because C content was excessive. 21 is a case in which micro-martensite formation could not be inhibited because Mn content was excessive. 28 is a case in which the prescribed tensile strength could not be achieved because the cooling rate during patenting was slow.

The invention steels A, B, C and D among the Examples were used to produce steel wire for 0.2 mm diameter steel cord. The steel wires obtained exhibited tensile strength of 4053 MPa, 4197 MPa, 4394 MPa and 4550 MPa, respectively, and did not experience delamination. On the other hand, a similar product made from the comparative steel 21 had TS of 4316 MPa and experienced delamination.

FIG. 1 shows how reduction of area varied as a function of non-pearlite area ratio in invention steels and comparative steels. It can be seen that the invention steels, which had a non-pearlite area ratio of 3% or less, tended to have a high reduction of area. However, owing to the fact that, as pointed out earlier, reduction of area is also influenced by tensile strength, some overlapping data are present.

Figure 2:
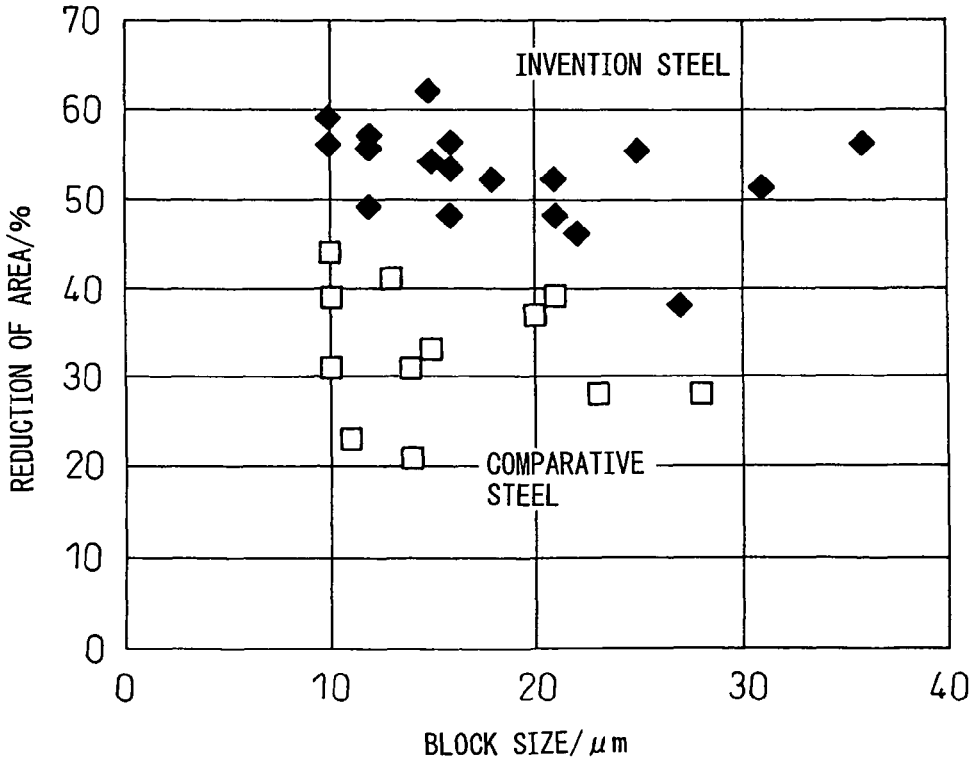
FIG. 2 is a diagram showing how reduction of area varied as a function of pearlite block size.

FIG. 2 shows how reduction of area varied as a function of pearlite block size in invention steels and comparative steels. It can be seen that the invention steels tended to have high reduction of area. However, owing to the fact that, as pointed out earlier, reduction of area is also influenced by tensile strength, some overlapping data are present.

Figure 3:
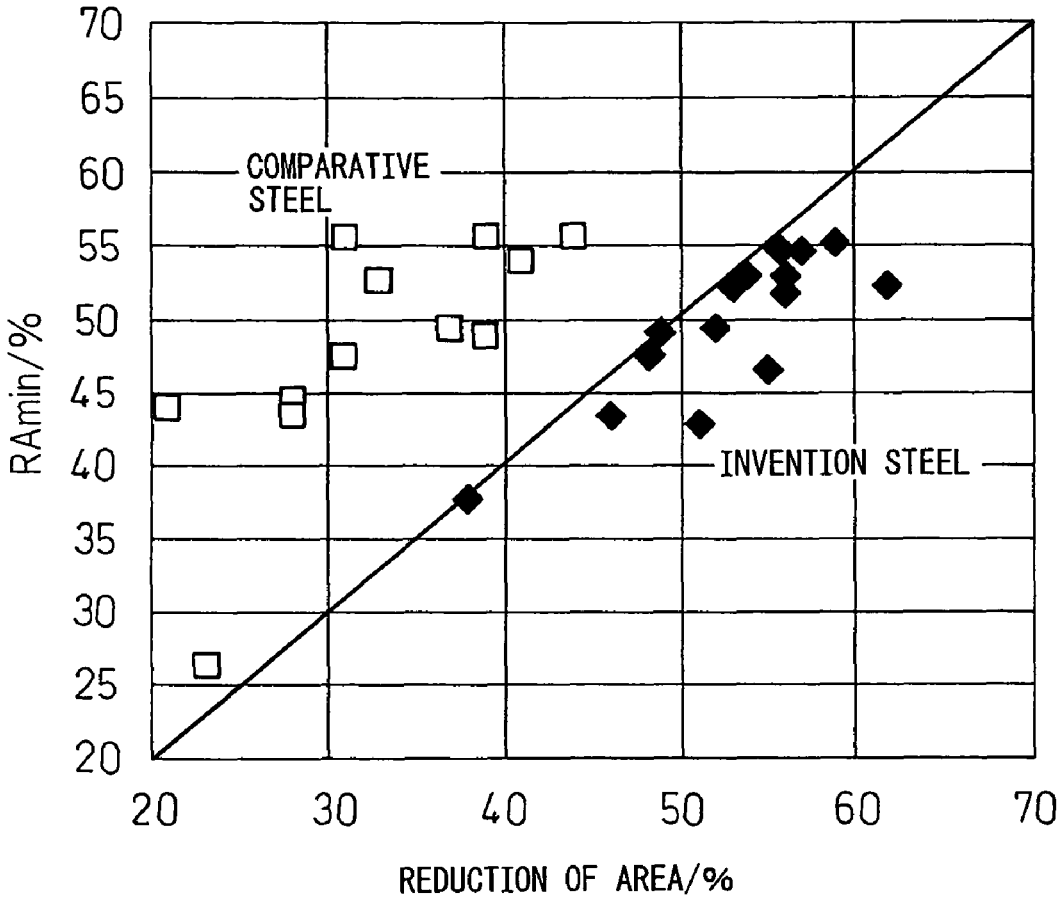
FIG. 3 is a diagram showing how actual reduction of area varied as a function of the reduction of area lower limit RAmin calculated according to Expression. (1).

FIG. 3 shows how actual reduction of area varied as a function of the reduction of area lower limit RAmin represented by Expression. (1). It can be seen that the area reductions of the invention steels were higher than RAmin.

In FIGS. 1 to 3, ◇ indicates an invention steel and □ represents a comparative steel.

This invention enables manufacture of steel cord usable as a reinforcing material in, for example, radial tires, various types of industrial belts, and the like, and also of rolled wire rod suitable for use in applications such as sewing wire.

What is claimed is:

1. A steel wire rod comprising in mass %,

C: 0.70 to 1.10%,

Si: 0.1 to 1.5%,

Mn: 0.1 to 1.0%

Al: 0.01% or less,

Ti: 0.01% or less,

N: 10 to 60 mass ppm,

B: not less than (0.77×N (mass ppm)−17.4) mass ppm or 3 mass ppm, whichever is greater, and not greater than 52 mass ppm, and having a balance of Fe and unavoidable impurities; and a post-patenting pearlite structure of an area ratio of 97% or greater and a balance of non-pearlite structures including bainite, degenerate-pearlite and pro-eutectoid ferrite, wherein the wire rod has an average pearlite block size of 10 μm or more, whose fracture reduction of area RA satisfies Expressions (1), (2) and (3) below and whose tensile strength TS satisfies Expression (4) below:

$$RA \geqq RAmin \quad (1),$$

where RAmin=a−b×pearlite block size (μm), $$a=-0.0001187\times[TS\ (\mathrm{MPa})]^2+0.31814\times TS\ (\mathrm{MPa})-151.32 \quad (2)$$

$$b=0.0007445\times TS\ (\mathrm{MPa})-0.3753 \quad (3)$$

$$TS \geqq 1000\times C\ (\text{mass }\%)-10\times\text{wire diameter (mm)}+320\ \mathrm{Mpa} \quad (4).$$

2. A steel wire rod according to claim 1, further comprising, in mass%, one or more members selected from the group consisting of:

Cr: 0.03 to 0.5%,

Ni: 0.5% or less (not including 0%),

Co: 0.5% or less (not including 0%),

V: 0.03 to 0.5%,

Cu: 0.2% or less (not including 0%),

Mo: 0.2% or less (not including 0%),

W: 0.2% or less (not including 0%), and

Nb: 0.1% or less (not including 0%).

3. A method of manufacturing the steel wire rod according to claim 1, comprising:

heating a wire rod having the chemical composition of claim 1 at a temperature between Tmin defined below and 1100° C.;

cooling the heated wire rod between 800° C. and 650° C. in which cooling rate is 50° C/s or greater; and subjecting the cooled wire rod to patenting treatment in an atmosphere of 500° C. to 650° C., and subjecting the wire rod to cold working;

said minimum heating temperature Tmin being 850° C. when B (mass ppm)−0.77×N (mass ppm)>0.0, and said minimum heating temperature Tmin being Tmin=1000+1450/(B (mass ppm)−0.77×N (mass ppm)−10)° C. when B (mass ppm)−0.77×N (mass ppm) ≦0.0.

4. A high-strength steel wire excellent in ductility, which is manufactured by subjecting the steel wire rod of claim 1 to cold drawing and has a tensile strength of 2800 MPa or greater.

* * * * *

UNITED STATES PATENT AND TRADEMARK OFFICE

CERTIFICATE OF CORRECTION

PATENT NO. : 8,168,011 B2
APPLICATION NO. : 11/922524
DATED : May 1, 2012
INVENTOR(S) : Shingo Yamasaki et al.

It is certified that error appears in the above-identified patent and that said Letters Patent is hereby corrected as shown below:

In the Specification

Column 2, line 53, change "RA ≥ Ramin" to -- RA ≥ RAmin --

Signed and Sealed this
Tenth Day of December, 2013

Margaret A. Focarino

Margaret A. Focarino
*Commissioner for Patents of the United States Patent and Trademark Office*